US007980543B2

(12) United States Patent
St. Ours et al.

(10) Patent No.: US 7,980,543 B2
(45) Date of Patent: Jul. 19, 2011

(54) PRINTING PRESS FOLDER WITH PARALLEL PROCESS TRANSPORT TAPES

(75) Inventors: Joseph Adrian St. Ours, Lee, NH (US); Lothar John Schroeder, Portsmouth, NH (US); Kevin Lauren Cote, Allen, TX (US)

(73) Assignee: Goss International Americas, Inc., Durham, NH (US)

( * ) Notice: Subject to any disclaimer, the term of this patent is extended or adjusted under 35 U.S.C. 154(b) by 768 days.

(21) Appl. No.: 11/891,561

(22) Filed: Aug. 10, 2007

(65) Prior Publication Data

US 2009/0038454 A1 Feb. 12, 2009

(51) Int. Cl.
*B41F 13/64* (2006.01)

(52) U.S. Cl. ..... 270/52.07; 270/10; 270/12; 270/13; 270/15; 270/19; 270/21.1; 270/47; 270/52.09

(58) Field of Classification Search ..... 270/5.02, 270/10, 11, 12, 13, 14, 15, 19, 21.1, 47, 52.07, 270/52.09

See application file for complete search history.

(56) References Cited

U.S. PATENT DOCUMENTS

| | | | | |
|---|---|---|---|---|
| 4,170,288 | A * | 10/1979 | Mebus | 198/440 |
| 4,381,106 | A * | 4/1983 | Loebach | 270/47 |
| 4,919,027 | A | 4/1990 | Littleton | |
| 4,948,112 | A * | 8/1990 | Sato et al. | 270/60 |
| 5,049,123 | A | 9/1991 | Breton et al. | |
| 5,098,075 | A * | 3/1992 | Lindblom | 270/52.14 |
| 5,112,033 | A * | 5/1992 | Breton | 270/47 |
| 5,607,146 | A | 3/1997 | Novick et al. | |
| 5,615,878 | A * | 4/1997 | Belanger et al. | 271/302 |
| 5,855,153 | A * | 1/1999 | Cote et al. | 83/23 |
| 6,170,371 | B1 | 1/2001 | Cote et al. | |
| 6,612,213 | B1 | 9/2003 | Bredenberg et al. | |
| 7,044,902 | B2 * | 5/2006 | d'Agrella et al. | 493/224 |
| 2007/0018373 | A1 * | 1/2007 | Shoji et al. | 270/4 |
| 2007/0158903 | A1 | 7/2007 | Cote et al. | |

* cited by examiner

*Primary Examiner* — Leslie A Nicholson, III
(74) *Attorney, Agent, or Firm* — Davidson, Davidson & Kappel, LLC

(57) ABSTRACT

A folder for a web printing press includes a cut cylinder cutting a web into signatures; a first transport belt having a first raised section; a second transport belt having a second raised section, the signatures being received from the cut cylinder so as to be located between the first and second raised sections; and at least one variable speed motor driving the first and second transport belts. A method is also provided.

4 Claims, 3 Drawing Sheets

PRINTING PRESS FOLDER WITH PARALLEL PROCESS TRANSPORT TAPES

The present invention relates generally to folders for web printing presses.

BACKGROUND OF THE INVENTION

Many folders used in web printing presses use driven belts or tapes to transport signatures from the cut cylinder to the next operation, such as signature deceleration or folding. These tapes contact the web or ribbons before the signature is created and have a velocity higher than that of the ribbon. The velocity difference causes relative motion (scrubbing) between the ribbons and tapes.

After a signature is created by the cut cylinder, the signature is accelerated by the tapes from ribbon or web speed, which generally matches the surface speed of the cut cylinder as well, to tape speed. The rate of signature acceleration depends on the mass of the signatures and on the normal force and coefficient of friction between the tapes and signatures. Variations in these factors cause position variations in the signatures when they reach the next device, such as a fan or jaw cylinder. Position variations include: signature-to-signature variation at a given press speed, variations due to press speed changes, and variations over time due to, for example, tape wear. Position variations cause the following problems: reduced maximum allowable press speed, increased need for manual phase adjustments, machine damage, and press downtime due to jammed signatures. Such problems are worse in variable cutoff applications and become worse as press speeds increase.

U.S. Pat. No. 4,919,027 shows a sheet diverting system and U.S. Pat. No. 6,612,213 shows a belt diverter. Both are hereby incorporated by reference herein.

SUMMARY OF THE INVENTION

The present invention provides a folder for a web printing press comprising: a cut cylinder cutting a web into signatures; a first transport belt having a first raised section; and a second transport belt having a second raised section, the signatures being received from the cut cylinder so as to be located between the first and second raised sections; and at least one variable speed motor driving the first and second transport belts so as to accelerate the signatures.

By providing raised belt sections and acceleration, head-to-tail spacing can be created while the signatures remain under positive control.

The present invention also provides a method for delivering signatures cut from a web comprising: receiving the signatures at a ribbon speed under positive control between two belts; and accelerating the two belts to create a spacing between the signatures.

BRIEF DESCRIPTION OF THE DRAWINGS

One embodiment of the present invention is shown with respect to the drawings in which.

DETAILED DESCRIPTION

Figure 1:
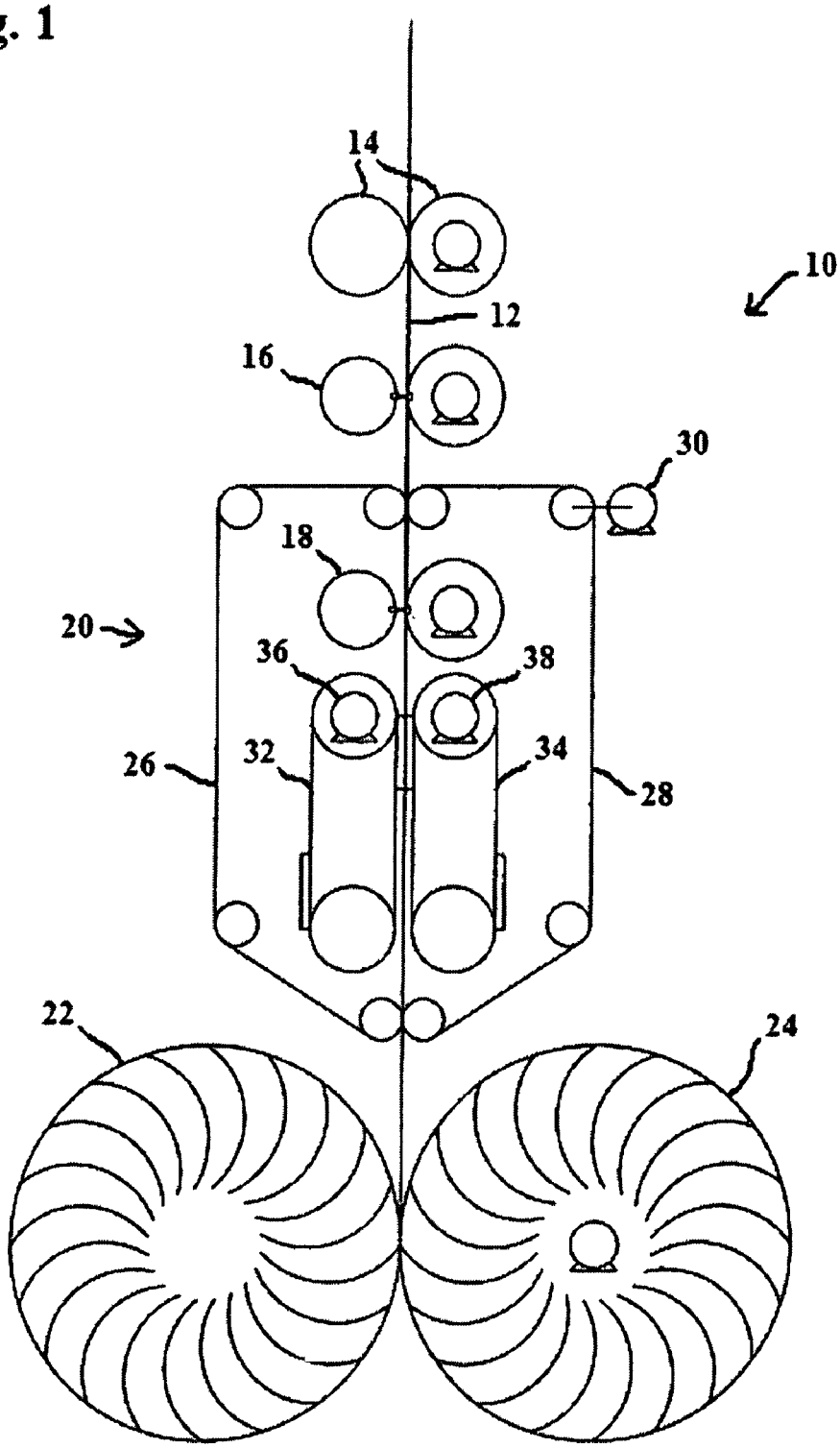
FIG. 1 shows a folder section including cut cylinders, a transport system, and slowdown fans.

FIG. 1 describes a folder section 10 according to the present invention, having an incoming web or ribbon 12, nip rollers 14, a first cut cylinder 16 interacting with a first anvil cylinder, a second cut cylinder 18 interacting with a second anvil cylinder, a transport system 20, and slowdown fans 22, 24. Transport system 20 includes tapes 26, 28 driven by a motor 30, and positive control transport belts 32, 34 driven by motors 36, 38. First cut cylinder 16 creates first perforations in ribbon 12, and second cut cylinder 18 creates signatures by cutting between the perforations. Transport system 20 delivers the signatures to slowdown fans 22, 24.

Figure 2:
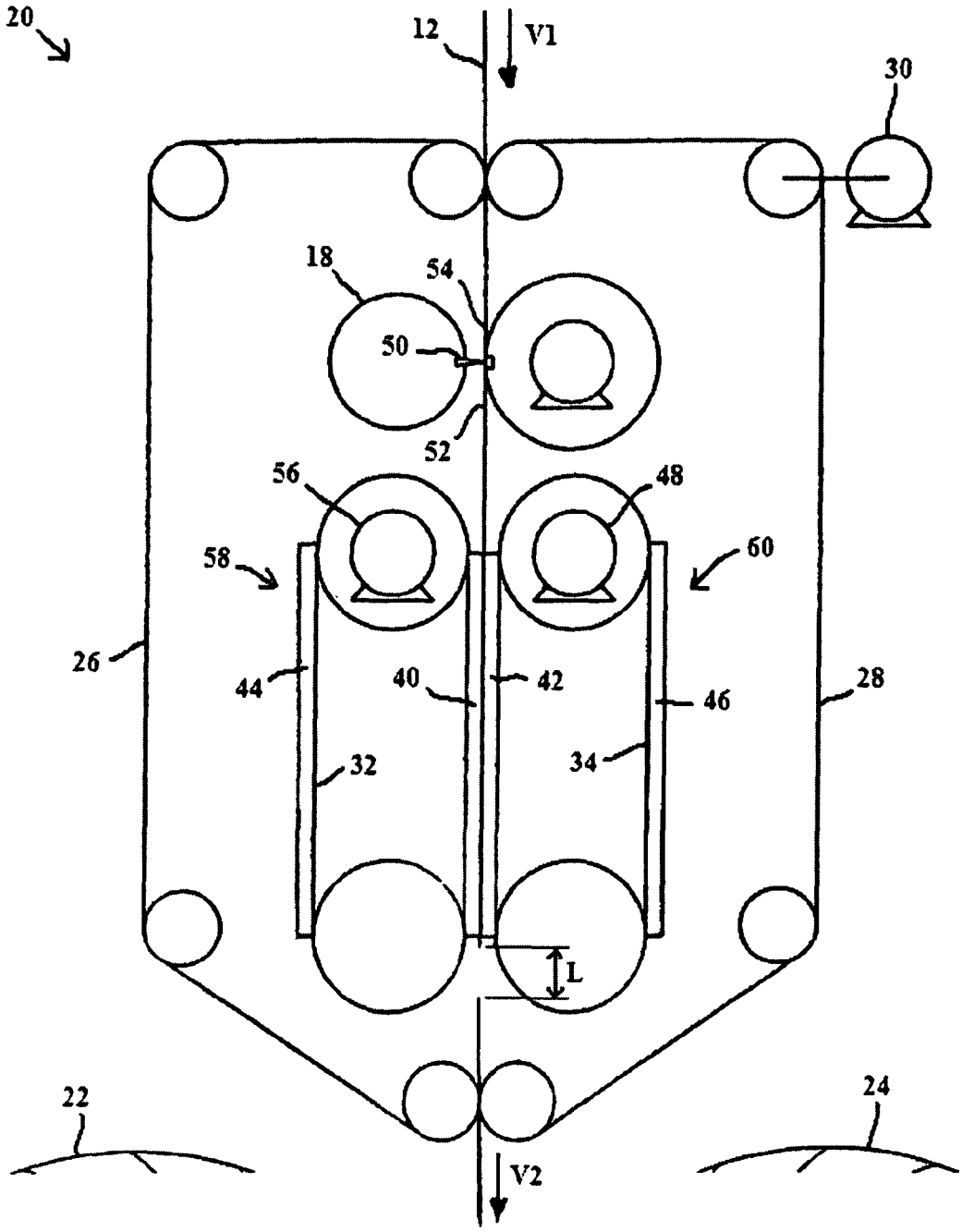
FIG. 2 shows an enlarged view of the transport system.

FIG. 2 shows transport system 20 schematically in more detail. Perforated ribbon 12 enters transport system 20 traveling at velocity V1. The lead edge of ribbon 12 is guided loosely by belts 26, 28 traveling at a higher velocity V2, but is not positively gripped by the belts 26, 28.

Ribbon 12 then is contacted by belt pads 40, 42. Belt pads 40, 42 are driven by motor 48 and, when belt pads first close on ribbon 12, belt pads 40, 42 are also traveling at velocity V1. Cut cylinder 18 then cuts a signature from ribbon 12 with a knife blade 50. Motor 48 then accelerates the signature and pads 40, 42 to velocity V2 of tapes 26, 28. The signature is then transported from pads 40, 42 to tapes 26, 28 for continued transportation to fans 22, 24. Alternately, rather than being delivered to fans 22, 24, signatures could be delivered to a jaw cylinder, for example.

When a signature is first created by cut cylinder 18, a trailing edge 52 of the new signature is contacting a leading edge 54 of ribbon 12. By accelerating each signature in transport system 20 from V1 to V2, a head-to-tail distance L between consecutive signatures is advantageously created for delivery of the signatures to fans 22, 24.

Pads 40, 42 have positive control over the signature to prevent slipping between pads 40, 42 and the signature. Positive control advantageously minimizes position variations in signatures at the exit of transport system 20.

Transport belts 32, 34 may contain two sets of pads 40, 42 and 44, 46. Each set of pads 40, 42 and 44, 46 contacts every other signature and each belt 32, 34 can be driven by separate motors 48, 56. The spacing of the pads is such that the pads 40, 42 do not influence the signature contacted by the pads 44, 46 (and visa versa).

After releasing a signature and prior to contacting a subsequent signature, each set of pads 40, 42 and 44, 46 is decelerated on return paths 58, 60 to velocity V1 by variable speed motors 48, 56. Then pads 40, 42 and 44, 46 contact ribbon 12 again, and the process is repeated.

Figure 3A:
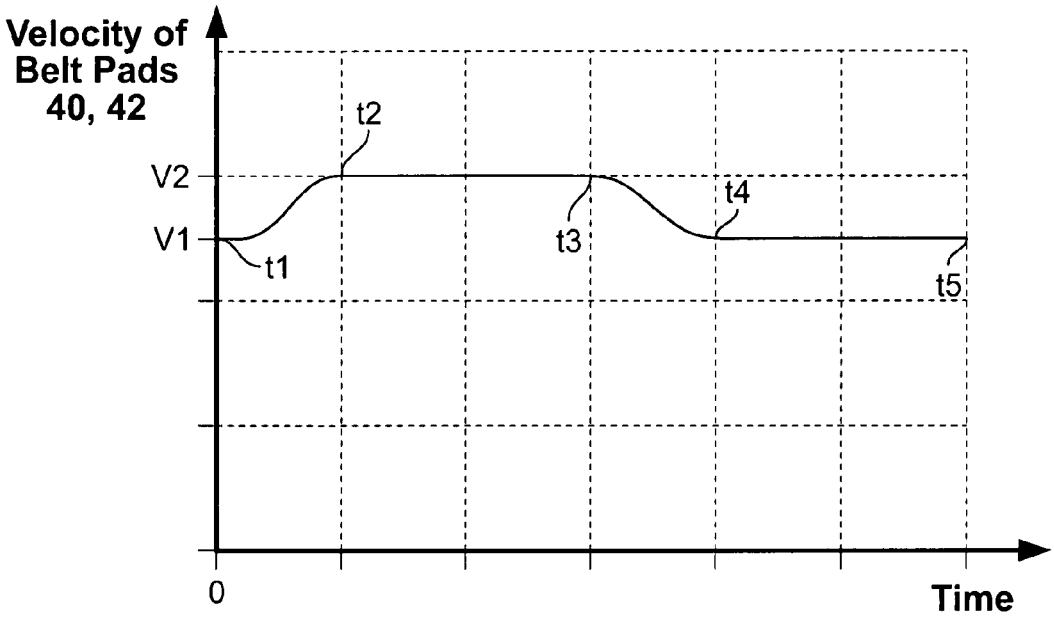
FIGS. 3A and 3B are plots of belt pad velocity as a function of time.
Figure 3B:
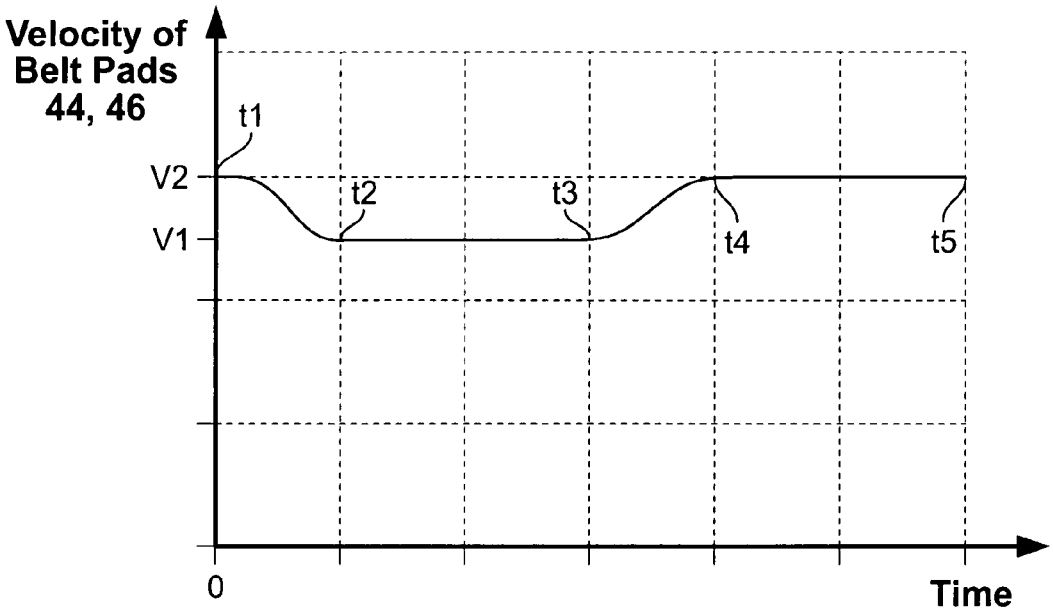

FIGS. 3A and 3B contain plots of velocity versus time for belt pads 40, 42 and belt pads 44, 46, respectively, during the creation of two consecutive signatures. In these figures, belt pads 40, 42 contact and accelerate the first signature, and belt pads 44, 46 contact and accelerate the second signature. The first signature is created by cut cylinder 18 at time t1 and the second is created by cut cylinder 18 at time t3.

Variable speed motors, such as servo motors available from Siemens Corporation, can be used to provide such velocity variation.

As shown in both FIGS. 3A and 3B, the velocity of belt pads 40, 42 and 44, 46 oscillates between ribbon velocity V1 and tape velocity V2. In FIG. 3A, at time t1, the velocity of belt pads 40, 42 equals ribbon velocity V1. Belt pads 40, 42 then accelerate the first signature and reach tape velocity V2 at time t2. Belt pads 40, 42 and signature A (SA) remain at velocity V2 until time t3 when belt pads 40, 42 deliver the first signature to tapes 26, 28 and begin to decelerate. Belt pads 40, 42 reach ribbon velocity V1 at time t4 and remain at velocity V1 until time t5 when a new signature is created and the process repeats.

As shown in FIG. 3B, the velocity of belt pads 40, 42 is the mirror image of the velocity of belt pads 44, 46. At time t1, belt pads 44, 46 deliver a preceding signature to tapes 26, 28 at velocity V2 and begin to decelerate. Belt pads 44, 46 reach velocity V1 at time t2. When the second signature is created at time t3, belt pads 44, 46 accelerate the second signature and reach velocity V2 at time t4. Belt pads 44, 46 and signature B (SB) remain at velocity V2 until the second signature is delivered at time t5.

Belt pad velocity profiles are not limited to those shown in FIGS. 3A and 3B. Alternately, these velocity profiles could be sinusoidal or piece-wise linear, for example. Varying the velocity profiles can set the spacing between signatures.

A single variable motor and gearing could also be used for the belts 32, 34.

What is claimed is:

1. A method for delivering signatures cut from a web comprising:

receiving the signatures at a ribbon speed under positive control between two belts, a first belt of the two belts including a first raised section and a second belt of the two belts including a second raised section, the receiving step including moving the first raised section and the second raised section towards each other to contact a first of the signatures at the same time; and accelerating the two belts to create a spacing between the signatures; and decelerating the first and second raised sections after the first and second raised sections release the first of the signatures.

2. The method as recited in claim 1 wherein the spacing is varied by changing a velocity profile of at least one motor driving the two belts.

3. The method as recited in claim 1 wherein the first belt includes a third raised section spaced apart from the first raised section and the second belt includes a fourth raised section spaced apart from the second raised section, the receiving step including moving the third raised section and the fourth raised section towards each other to contact a second of the signatures at the same time, the second of the signatures directly following the first of the signatures.

4. The method as recited in claim 1 wherein the accelerating step includes accelerating the first and second raised sections from a first velocity to a second velocity.

* * * * *